US006504117B2

(12) United States Patent
Overstreet

(10) Patent No.: US 6,504,117 B2
(45) Date of Patent: Jan. 7, 2003

(54) FOOT OPERATED SWITCH FOR ELECTRICAL CIRCUITS

(75) Inventor: Mark J. Overstreet, Sandusky, MI (US)

(73) Assignee: Ametek, Inc., Paoli, PA (US)

( * ) Notice: Subject to any disclaimer, the term of this patent is extended or adjusted under 35 U.S.C. 154(b) by 0 days.

(21) Appl. No.: 10/090,913

(22) Filed: Mar. 4, 2002

(65) Prior Publication Data

US 2002/0079204 A1 Jun. 27, 2002

Related U.S. Application Data

(63) Continuation of application No. 09/698,345, filed on Oct. 27, 2000, now abandoned.

(51) Int. Cl.[7] ..... H01H 3/14
(52) U.S. Cl. ..... 200/86.5; 200/61.29; 200/51 LM
(58) Field of Search ..... 200/86.5, 61.29, 200/61.89, 335, 51 LM

(56) References Cited

U.S. PATENT DOCUMENTS 2,957,690 A * 10/1960 Ginn ..... 200/1 A
3,430,013 A * 2/1969 Wible ..... 200/86.5
3,983,344 A * 9/1976 Straihammer ..... 200/86.5
4,558,194 A 12/1985 Wiblin ..... 200/61.89
5,554,894 A * 9/1996 Sepielli ..... 307/112
5,838,131 A 11/1998 Telymonde ..... 318/560
5,934,152 A * 8/1999 Aschoff et al. ..... 123/399
6,040,537 A 3/2000 McClintock ..... 200/86.5

OTHER PUBLICATIONS

Internet Website Foot Switch descriptions, 16 pages, Oct. 16, 2000.

* cited by examiner

*Primary Examiner*—Elvin Enad
*Assistant Examiner*—Kyung Lee
(74) *Attorney, Agent, or Firm*—Young & Basile, P.C.

(57) ABSTRACT

A foot operated apparatus for providing a switch closure to an external electrical circuit. The apparatus includes a housing having a switch mounted therein carrying a plunger actuated electrical contact moveable between two positions. A foot operated member is pivotally mounted on the housing about a pivot axis. The foot operated member has a first end spaced from the housing at a normal first position and disposed below the upper disposed pivot axis. The first end of the foot operated member is pivotal about the pivot axis spaced above the first end of the foot operated member toward the housing to a second position coincident with closure of the switch contact. An optional foot guard encloses the sides and top of the foot operated member. The foot guard allows the toe portion of a user's foot to slide therethrough in forward movement to pivot the first end of the foot engaging member to the second position coincident with closure of the switch contact.

2 Claims, 3 Drawing Sheets

FOOT OPERATED SWITCH FOR ELECTRICAL CIRCUITS

This is a continuation of application Ser. No. 09/698,345 filed on OCT. 27, 2000 for FOOT OPERATED SWITCH FOR ELECTRICAL CIRCUITS, now abandoned.

BACKGROUND

Foot operated switches for controlling the application of electrical power to external electrical circuits are widely employed in industry.

A typical foot switch includes a base carrying a switch having at least one electrical contact which is capable of moving between an open position and a closed position upon depression of a pedal member pivotably mounted on the base. The switch contacts receive conductors which pass externally of the base for connection to an external circuit.

Such foot switches find widespread use in various industrial applications, such as providing a momentary "on" signal to start a machine, as well as a so-called "dead man's switch" wherein the external circuit controlled by the foot switch is typically a moving piece of machinery or vehicle. To operate the machine or to move the vehicle, the user must keep the foot switch depressed at all times. Removal of the user's foot from the foot switch deactivates the circuit controlled by the foot switch which will typically render the machine or vehicle inoperative or nonmovable.

However, regardless of the application, all of the known foot switches require a user or operator to place his or her weight on the foot switch to switch the contacts from the opened to the closed position. This weight or force is typically applied through the toe portion of the foot.

For momentary start signals, the high production rate common in the manufacturing facilities frequently necessitates hundreds of foot bending movements to activate the foot switch each time a machine cycle is to be initiated. In the case of the use of foot switches as a "dead man's switch" the lengthy time that the user must keep his or her foot on the foot switch and apply sufficient force to overcome the biasing spring force exerted against the foot pedal which normally moves the foot pedal to the raised, open contact position, proves to be extremely tiring over the course of a work day.

Thus, it would be desirable to provide a foot switch for use in controlling power to electrical circuits which is easier to use from an operator fatigue standpoint then previously devised foot switches.

SUMMARY OF THE INVENTION

The present invention is a foot operated apparatus or foot switch which provides a switch contact signal to an external electrical circuit. The foot operated apparatus includes a switch mounted in a housing and having a moveable plunger for switching a contact within the switch between first and second positions. A foot engagable member is pivotally mounted relative to the housing about a pivot axis carried on the housing. The foot engagable member having a first end opposite a second end affixed to the pivot axis. The pivot axis is spaced above the first end of the foot operated member in a normal use position of the housing, providing a substantially vertical orientation of the foot engagable member. The foot engagable member pivots about the pivot axis wherein the first end of the foot engagable member moves in a substantially horizontal direction upon actuation by the forward movement of a user's foot.

The foot operated apparatus or foot switch of the present invention has a unique operational mode whereby pivotal movement of the foot engaging member is about a pivot axis carried on the switch housing is disposed above the moveable end portion of the foot engaging member or foot pedal. In this manner, the foot switch of the present invention is operated merely by forward sliding movement of a user's foot into engagement with the foot pedal with sufficient force to overcome the foot pedal biasing force to move the foot pedal to the second position causing closure of the internal switch contact. It is believed that maintaining a user's foot in a stationary position against rearward movement to hold the foot pedal in the second switch closed position requires less force and is less tiring over long periods of use.

This makes the foot switch of the present invention ideal for use as a "dead man's switch" in moveable equipment, vehicles, etc.

BRIEF DESCRIPTION OF THE DRAWINGS

The various features, advantages and other uses of the present invention will become more apparent by referring to the following detailed description and drawing in which.

DETAILED DESCRIPTION OF THE PREFERRED EMBODIMENT

Referring now to FIGS. 1–5, there is depicted a foot switch 10 constructed in accordance with the teachings of the present invention. The foot switch 10 has a unique operation mode wherein pivotal movement of the foot pedal or moveable plate which actuates the internally mounted switch to move the switch contact or contacts from open to closed positions is effected by a sliding forward contact of the operator's foot with the bottom portion of the pivotal foot pedal as opposed to the normal foot switch operation wherein the user places his or her foot, or at least the toe portion of his or her foot on the foot pedal of a foot switch and then bends his or her foot downward about the ankle to pivot the foot pedal to the position closing the internal switch contacts.

Figure 1:
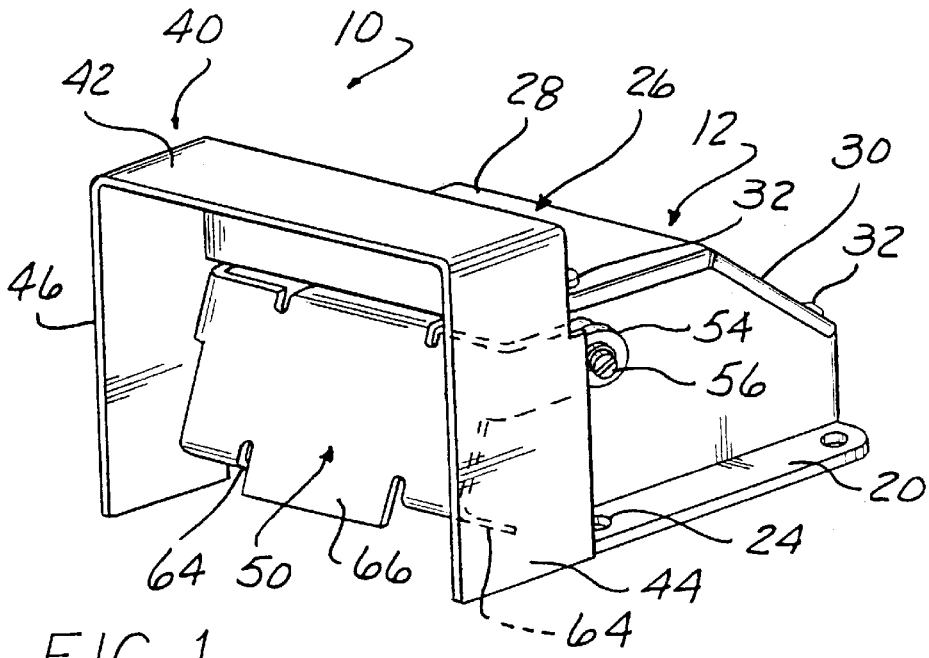
FIG. 1 is a front perspective view of a foot switch constructed in accordance with the teachings of the present inventions.
Figure 2:
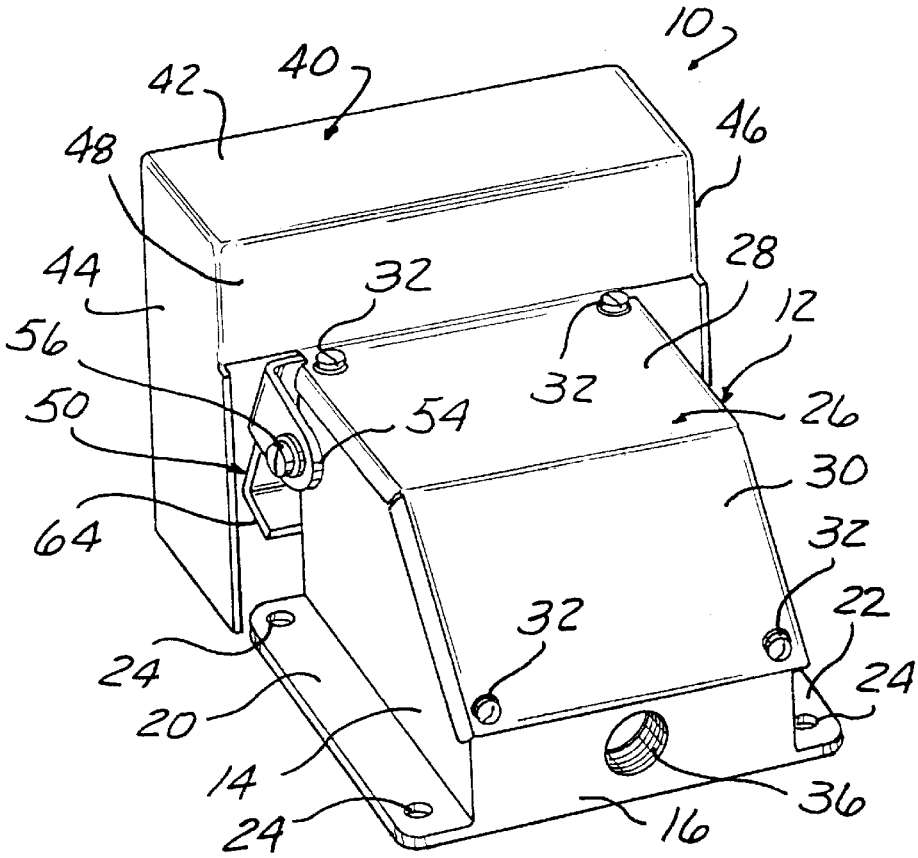
FIG. 2 is a rear perspective view of the foot switch shown in FIG. 1.
Figure 4:
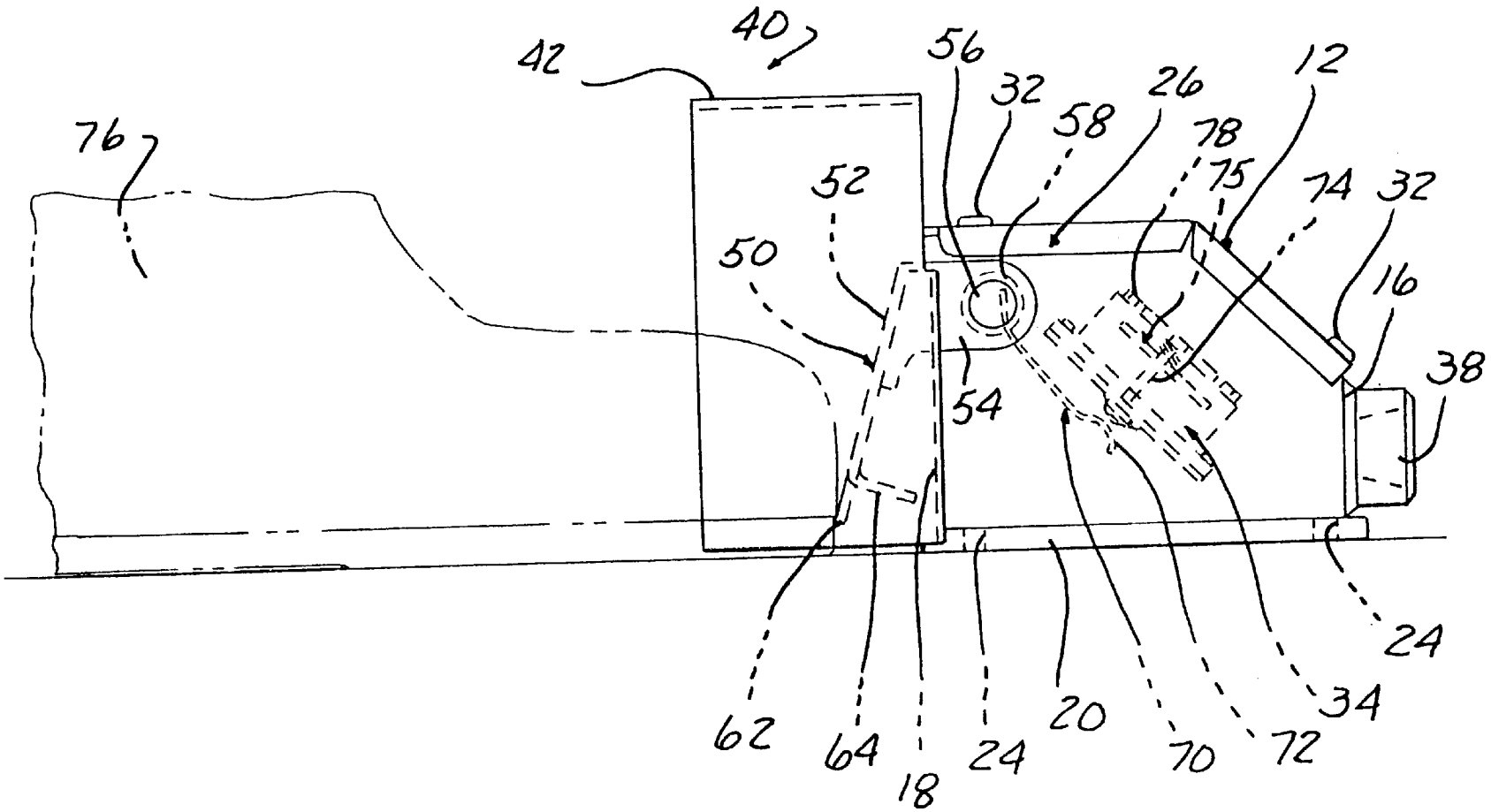
FIG. 4 is a side elevational, cross sectional view of the foot switch shown in FIGS. 1–3.

The foot switch 10 includes a housing 12 formed of a single or multi piece structure having opposed side walls 14 shown in FIGS. 1, 2 and 4, a rear wall 16, an opposed front wall 18 and spaced mounting surfaces in the form of flanges 20 and 22 extending laterally outward from each side wall 14. Each mounting flange 20 and 22 has at least one and preferably a pair of apertures 24 for mounting the housing 12 to a surface, such as a floor, by means of fasteners, such as screws, etc., not shown.

By way of example only, the upper portion of the housing 12 is formed with an open top end which is closed by a removable cover depicted generally by reference number 26. As shown in FIGS. 1, 2 and 4, the cover 26 has an angular, two-part, bent configuration formed of an upper cover wall 28 and an angled rear covered wall 30. Apertures are formed, preferably at the corners of the cover 26, and receive fasteners 32 which extend into threaded bores formed in the side walls 14 of the housing 12 as shown in FIG. 5.

Figure 5:
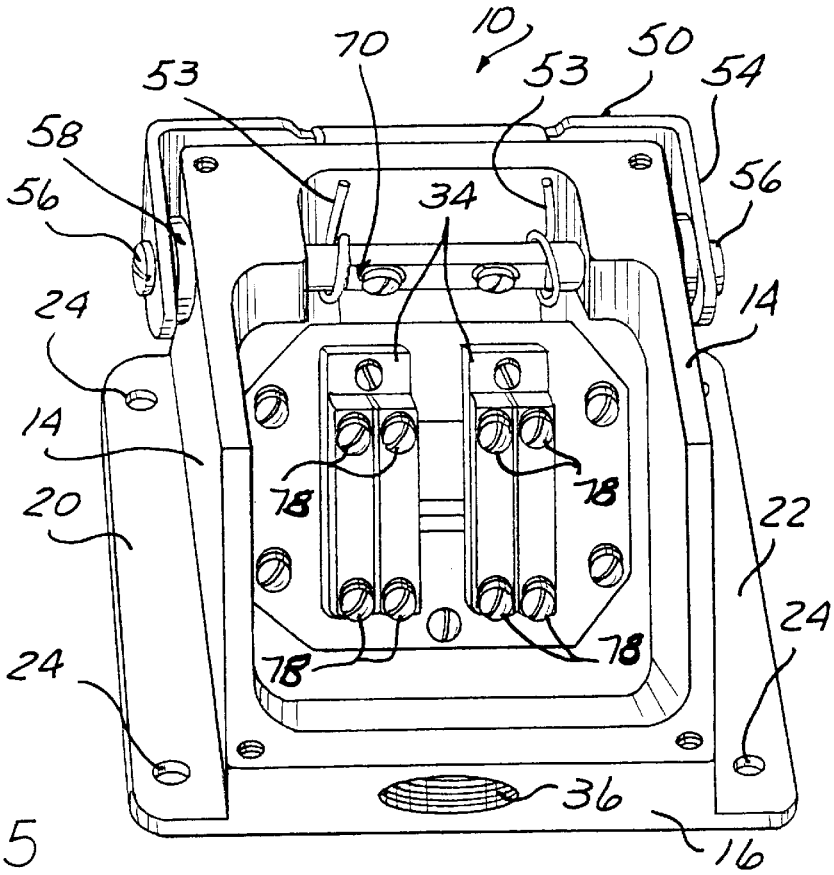
FIG. 5 is a top view of the foot switch with the housing cover and the optional foot guard removed.

The removable cover 26 allows access to the interior of the housing 12 for connection of electrical conductors, not shown, to the switch 34 mounted internally within an interior chamber formed within the housing 12 as shown in FIGS. 4 and 5.

A bore 36 is formed in the rear wall 16. The bore 36 preferably has internal threads for receiving a threaded coupling 38, shown in FIG. 4, for connection of a cable or a plurality of insulated electrical conductors. The conductors are connected to the contacts of the switch 34, as described hereafter, and provide an output signal indicative of the closure of the switch contacts upon pivotal movement of the foot pedal or foot engaging member from a normal first position to a second position.

An optional guard 40 is integrally formed as a unitary, one piece part of the housing 12 or as a separate member fixedly joined to the housing 12 by means of mechanical fasteners, or as by welding as shown in the preferred embodiment of the present invention. The guard 40 has a generally three-sided shape formed of a top wall 42 and a pair of opposed side walls 44 and 46. A filler member 48 extends between a rear edge of the top wall 42 and rear edges of the opposed side walls 44 and 46 to a front edge of an upper cover wall 28.

Figure 3:
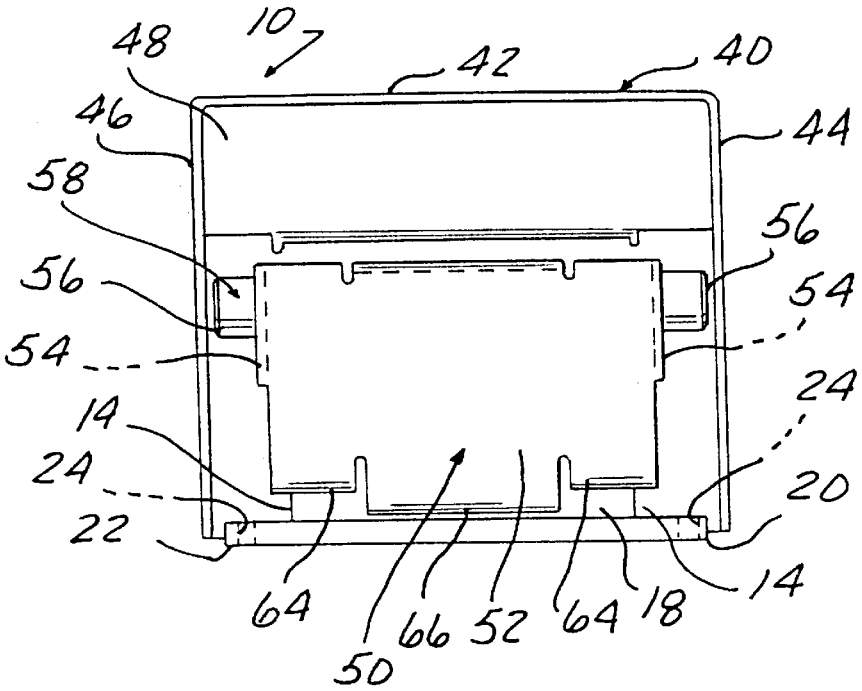
FIG. 3 is a front elevational view of the foot switch shown in FIG. 1.

As shown in FIGS. 1–3, the guard 40 projects forwardly of the housing 12 and surrounds a moveable foot engagable member or foot pedal 50. The guard 40 also forms an opening along the forward or front edges of the side walls 44 and 46 and the top wall 42 which allows access of a user's foot there through into contact with the foot pedal 50 as described hereafter.

The foot pedal 50 has a generally planar foot engaging surface formed by a plate 52. A pair of ears 54 extend rearwardly from an upper portion of the plate 52. Each ear 54 has an aperture which is mountable over an exposed end 56 of a pivot pin 58. The pivot pin 58 projects through the interior chamber of the housing 12, as seen in FIG. 5. Retainer clips, snap rings, etc., are employed to fixedly retain the ears 54 of the foot pedal 50 on the opposed end 56 of the pivot pin 58.

Biasing means, preferably in the form of a pair of coil springs 53, shown in FIG. 5, are mounted about the pivot pin 58 and bear against an internal surface within the housing 12 and the rear surface of the plate 52 to normally bias a first end 62 of the plate 52 of the foot pedal 50 to a normal, spaced, first position with respect to the front wall 18 of the housing 12. This first position of the foot pedal 50 defines a open position of the contact(s) in the foot switch 10.

For rigidity as well as to act as a depression movement stop, a pair of rearward facing bent tabs 64 are formed on either side of a depending central portion 66 of the plate 52. The ends of the bent tabs 64 will engage the front wall 18 of the housing 12 upon a full pivotal movement of the foot pedal 50. This position evidenced by engagement of the ends of the bent tabs 64 with the front wall 18 of the housing 12 defines the second position of the foot pedal 50 in which the contact(s) of the switch 34 in the foot switch 10 are typically in a closed position.

An actuator 70 is fixedly mounted at one end, by welding, mechanical fasteners, etc., to the pivot pin 58 as shown in FIGS. 4 and 5. A projection or boss 72 is formed on the other end of the actuator 70 in a position to engage and depress a moveable plunger 74 carried on the switch 34.

As shown in FIG. 4, in the first, normal or open position of the foot pedal 50, the projection 72 on the actuator 70 is spaced from the plunger 74. An internal spring in the switch 34 biases the plunger 74 outward from the housing of the switch 34. As is conventional in switch construction, the plunger 74 is connected to at least one moveable contact 75 within the housing of the switch 34 and is capable of moving the contact 75 between a first position which is typically a normally open electrical position wherein an electrical circuit passing through opposed terminals 78 on the switch 34 are open and a second, typically closed position wherein an electrical circuit is formed between the switch terminals 78 by means of the bridging contact 75.

When the foot pedal 50 is pivoted by engagement with the toe portion of a user's foot as shown in phantom by reference number 76 in FIG. 4, the foot pedal 50 is pivoted about the upper disposed pivot pin 58 to the second position wherein the boss 72 on the actuator 70 engages and depressed the plunger 74 on the switch 34 moving the switch contact 75 to the closed position, completing a circuit between the switch terminals 78 which are connected to electrical conductors passing through the coupling 38 to an external electrical circuit, not shown.

The foot switch 10 of the present invention has a unique operation wherein only the toe portion of a user's foot 76 contacts the foot engaging member or foot pedal 50. Forward sliding movement of the user's foot 76 toward the front wall 18 of the housing 12 of the foot switch 10 pivots the foot pedal 50 about the upper disposed pivot pin 58 to the second position closing the contacts in the switch 34 to provide an electrical signal or to complete an electrical circuit external of the foot switch 10. The user need only maintain his foot 76 in this forward position in contact with the foot pedal 50 to maintain the contact in the foot switch 10 in the closed position. It is believed that the force required to hold the user's foot stationary against the pivoted foot pedal 50 is much less than that required to depress a pivotal foot pedal in a standard foot switch over lengthy periods of time.

What is claimed is:

1. An electrical switch apparatus adapted to be operated by forward extension of an operator's foot comprising:

a housing comprising opposed sidewalls each having upper, lower and front edges, an upper cover extending between the sidewall upper edges, first and second opposed flanges extending from the side wall lower edges for mounting the housing on a floor surface with the sidewalls extending upwardly therefrom;

said sidewalls and cover, when said housing is mounted on a floor surface, defining an opening of such size and shape as to receive therein and between said sidewalls with the toe of a human foot;

a pivot pin defining a pivot axis and extending between said sidewalls proximate the sidewall upper and front edges and extending between said sidewalls;

a substantially planar pedal plate attached to said pivot pin for pivotal motion about the pivot axis;

a spring element operatively connected between the housing and pedal plate to bias the plate to a vertical position across the opening and essentially parallel to the sidewall front edges when the housing is mounted on the floor surface but to resiliently resist pivotal motion of the pedal plate into the housing; and an electrical switch disposed within the housing and operatively connected to the pedal plate to be switched by movement of the pedal plate about the pivot pin in the housing.

2. The electrical switch apparatus defined in claim 1 further including a foot guard attached to the housing and extending around the opening parallel to the front edges and upper edges of the housing.

* * * * *